US011620942B2

(12) United States Patent
Yang et al.

(10) Patent No.: US 11,620,942 B2
(45) Date of Patent: Apr. 4, 2023

(54) PIXEL CIRCUIT, DRIVING METHOD THEREOF AND DISPLAY DEVICE

(71) Applicant: BOE TECHNOLOGY GROUP CO., LTD., Beijing (CN)

(72) Inventors: Chengchung Yang, Beijing (CN); Xueling Gao, Beijing (CN); Kuanjun Peng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 521 days.

(21) Appl. No.: 16/466,418

(22) PCT Filed: Nov. 21, 2018

(86) PCT No.: PCT/CN2018/116769
§ 371 (c)(1),
(2) Date: Jun. 4, 2019

(87) PCT Pub. No.: WO2019/134459
PCT Pub. Date: Jul. 11, 2019

(65) Prior Publication Data

US 2021/0358405 A1 Nov. 18, 2021

(30) Foreign Application Priority Data

Jan. 5, 2018 (CN) ..... 201810012007.3

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/3233; G09G 3/3208–3258; H01L 27/32–3293
See application file for complete search history.

(56) References Cited

U.S. PATENT DOCUMENTS

2015/0371590 A1* 12/2015 Jeong ..... G09G 3/3291 345/82
2017/0124941 A1 5/2017 Na et al.
(Continued)

FOREIGN PATENT DOCUMENTS

CN 1659617 A 8/2005
CN 101226719 A 7/2008
(Continued)

OTHER PUBLICATIONS

International Search Report and Written Opinion dated Feb. 13, 2019 from National Intellectual Property Administration PRC (ISA/CN).
(Continued)

*Primary Examiner* — Sanjiv D. Patel
(74) *Attorney, Agent, or Firm* — Dilworth & Barrese, LLP.; Michael J. Musella, Esq.

(57) ABSTRACT

A pixel circuit, a driving method thereof and a display device are provided. The pixel circuit includes a drive circuit, a data writing circuit, a compensation-and-reset circuit, and a storage circuit. The drive circuit includes a control terminal, a first terminal and a second terminal, and is configured to control a driving current for driving a light-emitting element to emit light; the data writing circuit is configured to write a data signal to the control terminal of the drive circuit in response to a scanning signal; the compensation-and-reset circuit is configured to apply the reset voltage to the control terminal of the drive circuit in response to a compensation signal; the storage circuit is configured to store the data signal that is wrote and a threshold voltage, and to couple and adjust a voltage of the control terminal of the drive circuit.

13 Claims, 10 Drawing Sheets

(52) U.S. Cl.
CPC ..... *G09G 2300/0852* (2013.01); *G09G 2320/0233* (2013.01); *G09G 2320/0257* (2013.01)

(56) References Cited

U.S. PATENT DOCUMENTS

| | | | | |
|---|---|---|---|---|
| 2017/0270860 | A1* | 9/2017 | Wang | G09G 3/3258 |
| 2018/0190197 | A1* | 7/2018 | Chang | H01L 27/3262 |
| 2019/0051247 | A1 | 2/2019 | Chang et al. | |
| 2019/0057982 | A1* | 2/2019 | Hwang | G09G 3/3258 |
| 2019/0066580 | A1 | 2/2019 | Xu | |

FOREIGN PATENT DOCUMENTS

| | | | |
|---|---|---|---|
| CN | 103035202 | A | 4/2013 |
| CN | 105632404 | A | 6/2016 |
| CN | 106981269 | A | 7/2017 |
| CN | 107346654 | A | 11/2017 |
| CN | 108257549 | A | 7/2018 |
| EP | 3343552 | A1 | 4/2018 |

OTHER PUBLICATIONS

Second Chinese Office Action from Chinese Patent Application No. 201810012007.3 dated Oct. 11, 2021.

* cited by examiner

PIXEL CIRCUIT, DRIVING METHOD THEREOF AND DISPLAY DEVICE

The present application claims priority of the Chinese Patent Application No. 201810012007.3, filed on Jan. 5, 2018, the disclosure of which is incorporated herein by reference in its entirety as a part of this application.

TECHNICAL FIELD

Embodiments of the disclosure relate to a pixel circuit, a driving method thereof and a display device.

BACKGROUND

Organic Light-emitting Diode (OLED) display devices have gradually attracted widespread attention due to the advantages such as wide viewing angle, high contrast ratio, fast response speed and higher luminous brightness and lower driving voltage than inorganic light-emitting display devices and the like. Due to the above characteristics, organic light-emitting diodes (OLED) can be applied to devices with display functions such as mobile phones, displays, notebook computers, digital cameras, instruments and meters, etc.

Pixel circuits in OLED display devices generally adopt a matrix driving mode, which is divided into an Active Matrix (AM) driving method and a Passive Matrix (PM) driving method according to whether switching elements are used in each pixel unit. Although PMOLED has advantages such as simple process and low cost, it cannot meet the requirements of display with high resolution and large-size due to PMOLED's shortcomings such as cross talk, high power consumption, short lifetime and the like. In contrast, AMOLED integrates a group of thin film transistors and a storage capacitor(s) in the pixel circuit of each pixel. By controlling the thin film transistors and the storage capacitor(s), the current flowing through the OLED is controlled, so that the OLED emits light as required. Compared with PMOLED, AMOLED requires less driving current, lower power consumption and have longer service lifetime, which can meet the requirements of large-scale display with high resolution and multi-gray. Also, AMOLED has obvious advantages in angle of view, color restoration, power consumption, response time and the like, and is suitable for display devices with high information content and high resolution.

SUMMARY

At least one embodiment of the present disclosure provides a pixel circuit including a drive circuit, a data writing circuit, a compensation-and-reset circuit, and a storage circuit. The drive circuit includes a control terminal, a first terminal and a second terminal, and is configured to control a driving current for driving a light-emitting element to emit light; the data writing circuit is connected to the control terminal of the drive circuit and configured to write a data signal to the control terminal of the drive circuit in response to a scanning signal; the compensation-and-reset circuit is connected to the control terminal of the drive circuit and a reset voltage terminal, and is configured to electrically connect the control terminal and the second terminal of the drive circuit and apply a reset voltage to the control terminal of the drive circuit in response to a compensation signal so that the drive circuit is at a fixed off-bias state; the storage circuit is configured to store the data signal that is wrote and a threshold voltage and to couple and adjust a voltage of the control terminal voltage of the drive circuit.

For example, in the pixel circuit provided by an embodiment of the present disclosure, the control terminal of the drive circuit is connected to a first node, the first terminal of the drive circuit is connected to a second node, and the second terminal of the drive circuit is connected to a third node; the data writing circuit comprises a control terminal, a first terminal and a second terminal, which are respectively connected to a scanning line, a data line and the first node; the compensation-and-reset circuit is connected to a compensation signal terminal, a reset voltage terminal, the first node and the third node; the light-emitting element is connected to the third node and a second voltage terminal.

For example, in the pixel circuit provided by an embodiment of the present disclosure, the compensation-and-reset circuit includes a compensation sub-circuit and a reset sub-circuit. The compensation sub-circuit comprises a control terminal, a first terminal and a second terminal, which are respectively connected to the compensation signal terminal, the first node and the third node; the reset sub-circuit comprises a control terminal, a first terminal and a second terminal which are respectively connected to the compensation signal terminal, the reset voltage terminal and the first node, or are respectively connected to the compensation signal terminal, the reset voltage terminal and the third node.

For example, in the pixel circuit provided by an embodiment of the present disclosure, the storage circuit includes a first storage circuit and a second storage circuit. The first storage circuit is connected to the control terminal of the drive circuit and the first terminal of the drive circuit, and configured to store the data signal that is wrote; the second storage circuit is connected to a first voltage terminal and the first terminal of the drive circuit, and is configured to couple and adjust a voltage of the control terminal of the drive circuit.

For example, the pixel circuit provided by one embodiment of the present disclosure further includes a light-emitting control circuit. The light-emitting control circuit includes a control terminal, a first terminal, and a second terminal connected to a light-emitting control line, the first voltage terminal, and the second node, respectively, and configured to apply a first voltage to the second node in response to a light-emitting control signal.

For example, in the pixel circuit provided by an embodiment of the present disclosure, the drive circuit includes a first transistor. The gate electrode of the first transistor is connected to the first node and serves as the control terminal of the drive circuit, the first electrode of the first transistor is connected to the second node and serves as the first terminal of the drive circuit, and the second electrode of the first transistor is connected to the third node and serves as the second terminal of the drive circuit.

For example, in the pixel circuit provided by an embodiment of the present disclosure, the data writing circuit includes a second transistor. A gate electrode of the second transistor, as the control terminal of the data writing circuit, is configured to be connected to the scanning line to receive the scanning signal, a first electrode of the second transistor, as the first terminal of the data writing circuit, is configured to be connected to the data line to receive the data signal, and a second electrode of the second transistor, as the second terminal of the data writing circuit, is connected to the first node.

For example, in the pixel circuit provided by an embodiment of the present disclosure, the compensation sub-circuit includes a third transistor. A gate electrode of the third transistor is configured to be connected to the compensation signal terminal to receive the compensation signal and serves as the control terminal of the compensation sub-circuit, a first electrode of the third transistor is connected to the first node and serves as the first terminal of the compensation sub-circuit, and a second electrode of the third transistor is connected to the third node and serves as the second terminal of the compensation sub-circuit.

For example, in the pixel circuit provided by an embodiment of the present disclosure, the first storage circuit includes a first storage capacitor. A first electrode of the first storage capacitor is connected to the first node, and a second electrode of the first storage capacitor is connected to the second node.

For example, in the pixel circuit provided by an embodiment of the present disclosure, the second storage circuit includes a second storage capacitor. A first electrode of the second storage capacitor is configured to be connected to the first voltage terminal to receive a first voltage, and a second electrode of the second storage capacitor is connected to the second node.

For example, in the pixel circuit provided by an embodiment of the present disclosure, the reset sub-circuit includes a fourth transistor. A gate electrode of the fourth transistor is configured to be connected to the compensation signal terminal to receive the compensation signal and serves as the control terminal of the reset sub-circuit, a first electrode of the fourth transistor is configured and connected to the reset voltage terminal to receive the reset voltage and serves as the first terminal of the reset sub-circuit, a second electrode of the fourth transistor is connected to the first node and serves as the second terminal of the reset sub-circuit, or the second electrode of the fourth transistor is connected to the third node and serves as the second terminal of the reset sub-circuit.

For example, in the pixel circuit provided by an embodiment of the present disclosure, the light-emitting control circuit includes a fifth transistor. A gate electrode of the fifth transistor is configured to be connected to the light-emitting control line, as the control terminal of the light-emitting control circuit, to receive the light-emitting control signal, a first electrode of the fifth transistor is configured to be connected to the first voltage terminal, as the first terminal of the light-emitting control circuit, to receive the first voltage, and a second electrode of the fifth transistor, as the second terminal of the light-emitting control circuit, is connected to the second node.

At least one embodiment of the present disclosure further includes a display device including a plurality of pixel units arranged in an array. Each of the plurality of pixel units includes a pixel circuit provided by any one of embodiments of the present disclosure and a light-emitting element.

For example, the display device provided by an embodiment of the present disclosure further includes a plurality of scanning lines. The plurality of pixel units are arranged in a plurality of rows, control terminals of data writing circuits of pixel circuits of pixel units in a row are connected to a same scanning line, control terminals of compensation-and-reset circuits of the pixel circuits of the pixel units in the row are connected to another scanning line, and the another scanning line is also connected to control terminals of data writing circuits of pixel circuits of pixel units in a previous row.

For example, the display device provided by an embodiment of the present disclosure further includes a plurality of scanning lines and a plurality of reset control lines; the plurality of pixel units are arranged in a plurality of rows, control terminals of data writing circuits of pixel circuits of pixel units in a row are connected to a same scanning line, and control terminals of compensation-and-reset circuits of the pixel circuits of the pixel units in the row are connected to a same reset control line.

At least one embodiment of the present disclosure also provides a driving method for a pixel circuit, including a reset and compensation stage, a data writing stage, and a light-emitting stage. In the reset and compensation stage, the compensation signal is input, the compensation-and-reset circuit is turned on, the first storage circuit is reset, and the drive circuit is compensated so that the drive circuit is in a fixed off-bias state; in the data writing stage, the scanning signal and the data signal are input, the data writing circuit is turned on, the data writing circuit writes the data signal into the first storage circuit, and the second storage circuit couples and adjusts a voltage of the first terminal of the drive circuit according to a voltage variation of the control terminal of the drive circuit; In the light-emitting stage, the driving current is applied to the light-emitting element to drive the light-emitting element to emit light.

At least one embodiment of the present disclosure also provides a driving method for a pixel circuit, including a reset and compensation stage, a data writing stage, and a light-emitting stage. In the reset and compensation stage, the compensation signal is input, the compensation-and-reset circuit is turned on, the first storage circuit is reset, and the drive circuit is compensated so that the drive circuit is in a fixed off-bias state; in the data writing stage, the scanning signal and the data signal are input, the data writing circuit is turned on, the data writing circuit writes the data signal into the first storage circuit, and the second storage circuit couples and adjusts a voltage of the second node according to a voltage variation of the first node; in the light-emitting stage, the light-emitting control signal is input, the light-emitting control circuit and the drive circuit are turned on, the second storage circuit couples and adjusts a voltage of the first node according to a voltage variation of the second node, and the light-emitting control circuit applies the driving current to the light-emitting element to drive the light-emitting element to emit light.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make objects, technical solutions and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Due to the hysteresis effect of a drive transistor, when a display device displays a same image for a period of time and switches the image that is displayed previous to a next image, the previous display image will partially remain and emerge in the next image, and an after image will disappear after a period of time. The phenomenon is called a short-term after image. The hysteresis effect is mainly caused by the drift of a threshold voltage (Vth) caused by the residual movable ions in the drive transistor. Because $V_{GS}$ (a voltage between the gate electrode of the drive transistor and a source electrode of the drive transistor) in an initialization stage may be different when different pictures are switched to be displayed, different degrees of the shift of the threshold voltage of the drive transistor may be caused, thereby resulting in the short-term after image.

Figure 1A:
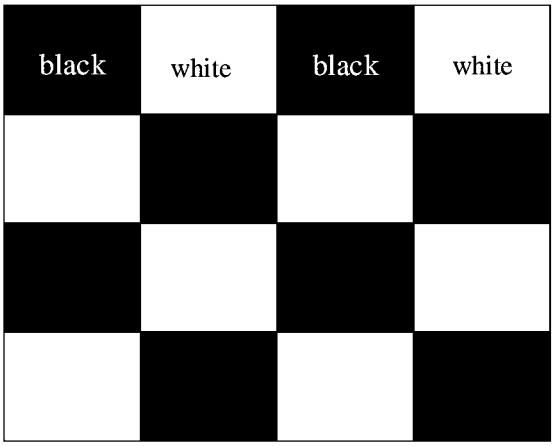
FIG. 1A is a schematic diagram of an image one displayed by a display device.
Figure 1B:
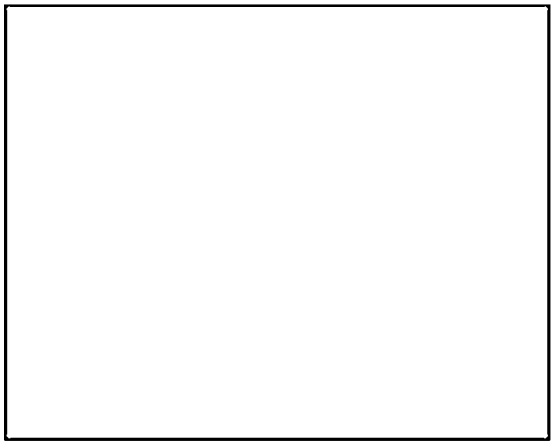
FIG. 1B is a schematic diagram of an image 2 to be displayed by a display device.
Figure 1C:
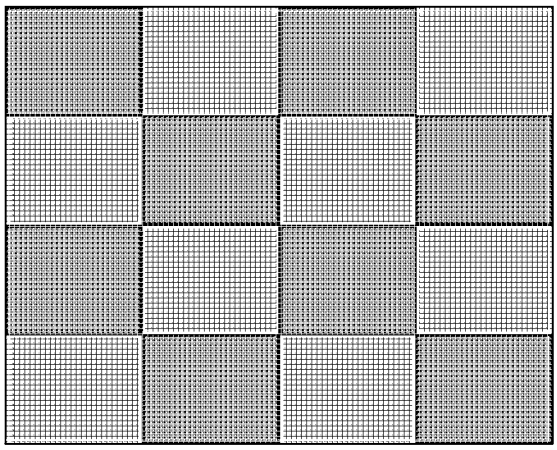
FIG. 1C is a schematic diagram of the image 2 actually displayed by a display device.

For example, FIG. 1A is a schematic diagram of an image one displayed by a display device, FIG. 1B is a schematic diagram of an image 2 to be displayed by the display device, and FIG. 1C is a schematic diagram of the image 2 actually displayed by the display device. After the display device displays an image such as a black-and-white checkerboard image as shown in FIG. 1A for a period of time, when the image displayed by the display device is switched to a new image 2 such as an image with a gray scale of 48 as shown in FIG. 1B, the checkerboard image of the image one as shown in FIG. 1A will still remain partially, as shown in FIG. 1C.

At least one embodiment of the present disclosure provides a pixel circuit. The pixel circuit comprises a drive circuit, a data writing circuit, a compensation-and-reset circuit and a storage circuit. The drive circuit includes a control terminal, a first terminal and a second terminal, and is configured to control a driving current for driving a light-emitting element to emit light; the data writing circuit is connected to the control terminal of the drive circuit and is configured to write a data signal to the control terminal of the drive circuit in response to the scanning signal; the compensation-and-reset circuit is connected to the control terminal of the drive circuit and a reset voltage terminal, and is configured to electrically connect the control terminal of the drive circuit and the second terminal of the drive circuit and apply a reset voltage to the control terminal of the drive circuit in response to the compensation signal so that the drive circuit is at a fixed off-bias state; the storage circuit is configured to store the data signal that is wrote and a threshold voltage, and to couple and adjust a voltage of the control terminal of the drive circuit.

At least one embodiment of the present disclosure also provides a driving method and a display device corresponding to the pixel circuit.

According to the pixel circuit, the driving method and the display device provided by the above embodiments of the present disclosure, on the one hand, the driving transistor in the pixel circuit can be in an off-bias state with $V_{GS}$ being a fixed bias in the reset and compensation stage, so that the problem of the short-term after image possibly caused by hysteresis effect can be eliminated; on the other hand, a voltage drop of a power line and the threshold voltage of the drive circuit can be compensated, so that the phenomenon of uneven display of the display device can be avoided, and the display effect of the display device including the pixel circuit can be improved.

Embodiments of the present disclosure and examples thereof will be described in detail below with reference to the accompanying drawings.

Figure 2:
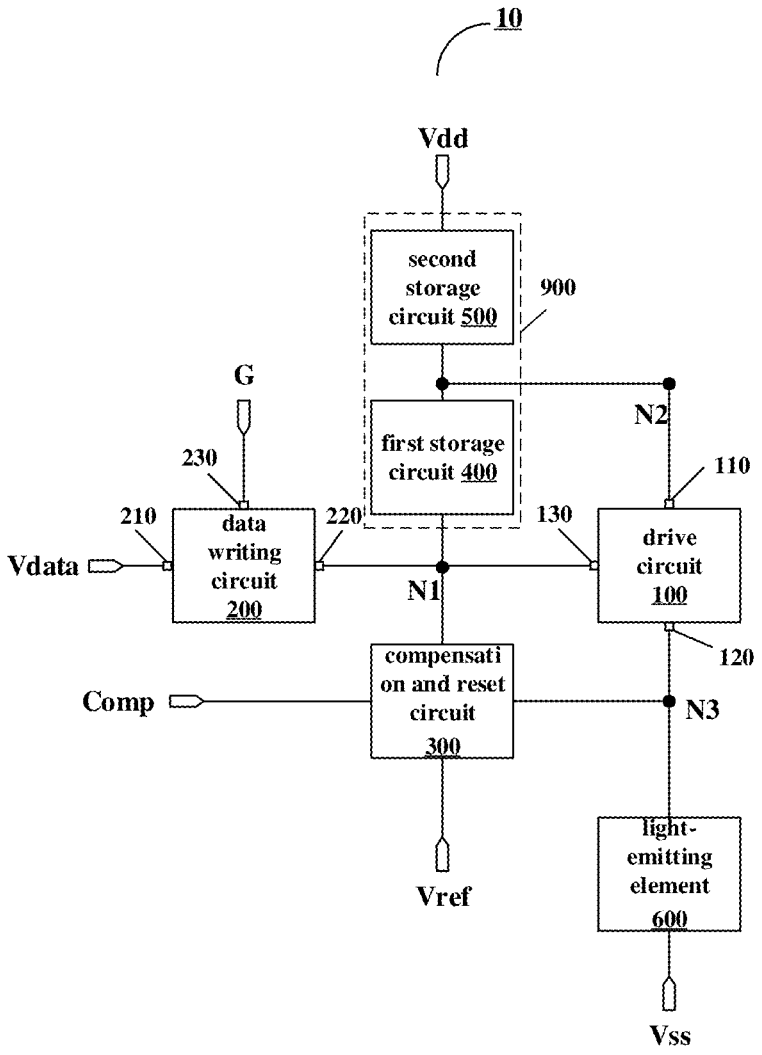
FIG. 2 is a schematic block diagram of a pixel circuit according to an embodiment of the present disclosure.

An example of an embodiment of the present disclosure provides a pixel circuit 10, for example, is used to sub-pixels of an OLED display device. As shown in FIG. 2, the pixel circuit 10 includes a drive circuit 100, a data writing circuit 200, a compensation-and-reset circuit 300, and a storage circuit 900. For example, the storage circuit 900 includes a first storage circuit 400 and a second storage circuit 500.

For example, the drive circuit 100 includes a first terminal 110, a second terminal 120, and a control terminal 130, and is configured to control a driving current that drives a light-emitting element 600 to emit light. The control terminal 130 of the drive circuit 100 is connected to a first node N1, the first terminal 110 of the drive circuit 100 is connected to a second node N2, and the second terminal 120 of the drive circuit 100 is connected to a third node N3. For example, in a light-emitting stage, the drive circuit 100 may supply a driving current to the light-emitting element 600 to drive the light-emitting element 600 to emit light, and the light-emitting element 600 may emit light according to a desired "gray scale". For example, the light-emitting element 600 may adopt an OLED and is configured to be connected to the third node N3 and a second voltage terminal Vss, and embodiments of the present disclosure include but are not limited to this case.

For example, the data writing circuit 200 is connected to the control terminal 130 (the first node N1) of the drive circuit 100 and is configured to write a data signal to the control terminal 130 of the drive circuit 100 in response to a scan signal. For example, the data writing circuit 200 includes a first terminal 210, a second terminal 220, and a control terminal 230, and is connected to a data line (a data signal terminal Vdata), a first node N1, and a scan line (a scan signal terminal G), respectively.

For example, in a data writing stage, the data writing circuit 200 may be turned on in response to a scanning signal, so that the data signal may be written to the control terminal 130 (i.e., the first node N1) of the drive circuit 100, and the data signal may be stored in the first storage circuit 400 to generate the driving current for driving the light-emitting element 600 to emit light according to the data signal, for example, in the light-emitting stage.

For example, the compensation-and-reset circuit 300 is connected to the control terminal 130 (the first node N1) of the drive circuit 100 and a reset voltage terminal Vref, and is configured to electrically connect the control terminal 130 of the drive circuit 100 and the second terminal 120 of the drive circuit 100 and apply the reset voltage to the control terminal 130 of the drive circuit 100 in response to a compensation signal so that the drive circuit is at a fixed off-bias state. For example, the compensation-and-reset circuit 300 may be connected to a compensation signal terminal Comp, the reset voltage terminal Vref, the first node N1, and the third node N3.

Figure 3:
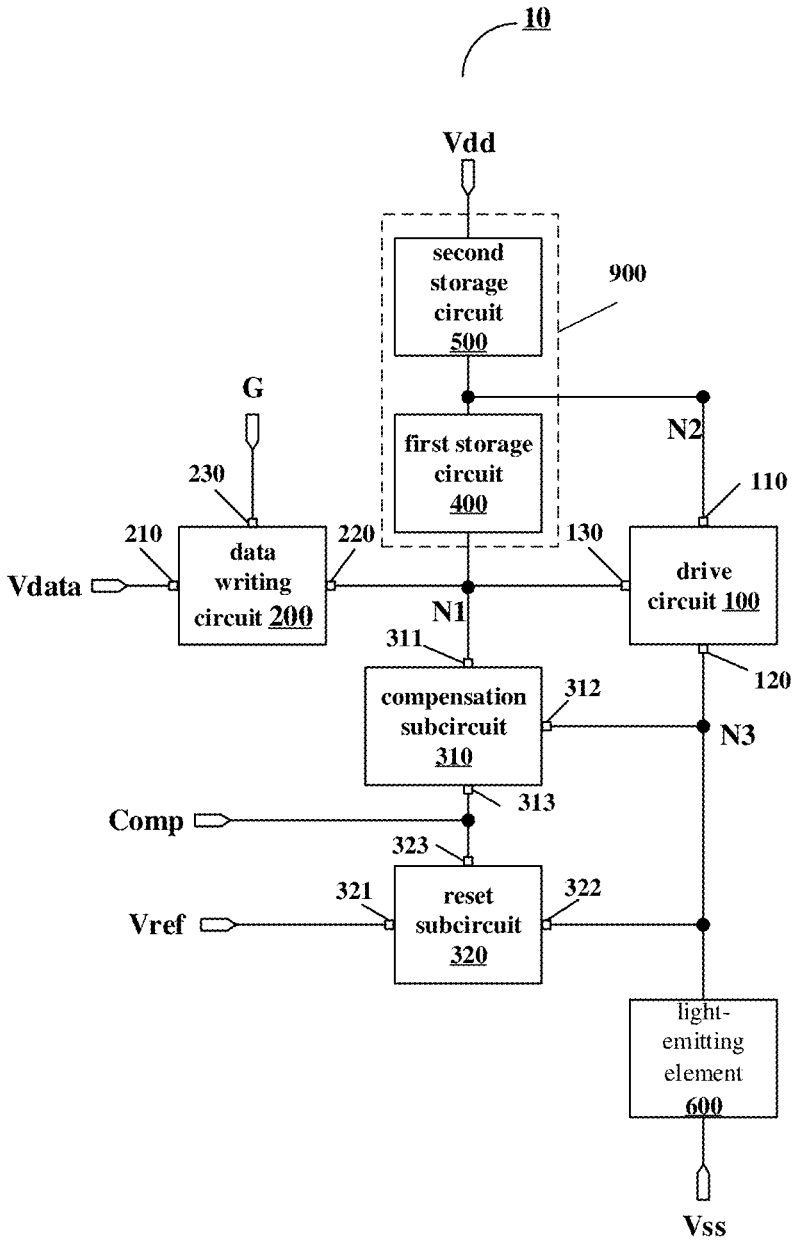
FIG. 3 is a schematic block diagram of another pixel circuit provided by an embodiment of the disclosure.

For example, as shown in FIG. 3, in an embodiment, the compensation-and-reset circuit 300 includes a compensation sub-circuit 310 and a reset sub-circuit 320. For example, the compensation sub-circuit 310 includes a first terminal 311, a second terminal 312, and a control terminal 313, which are respectively connected to the first node N1, the third node N3, and the compensation signal terminal Comp (a reset control line). For example, in a compensation stage, the compensation sub-circuit 310 can electrically connect the control terminal 130 of the drive circuit 100 and the second terminal 120 of the drive circuit 100, so that the relevant information of a threshold voltage of the drive circuit 100 can be stored in the first storage circuit 400 accordingly, thereby enabling the threshold voltage of the drive circuit 100 to be compensated.

Figure 4:
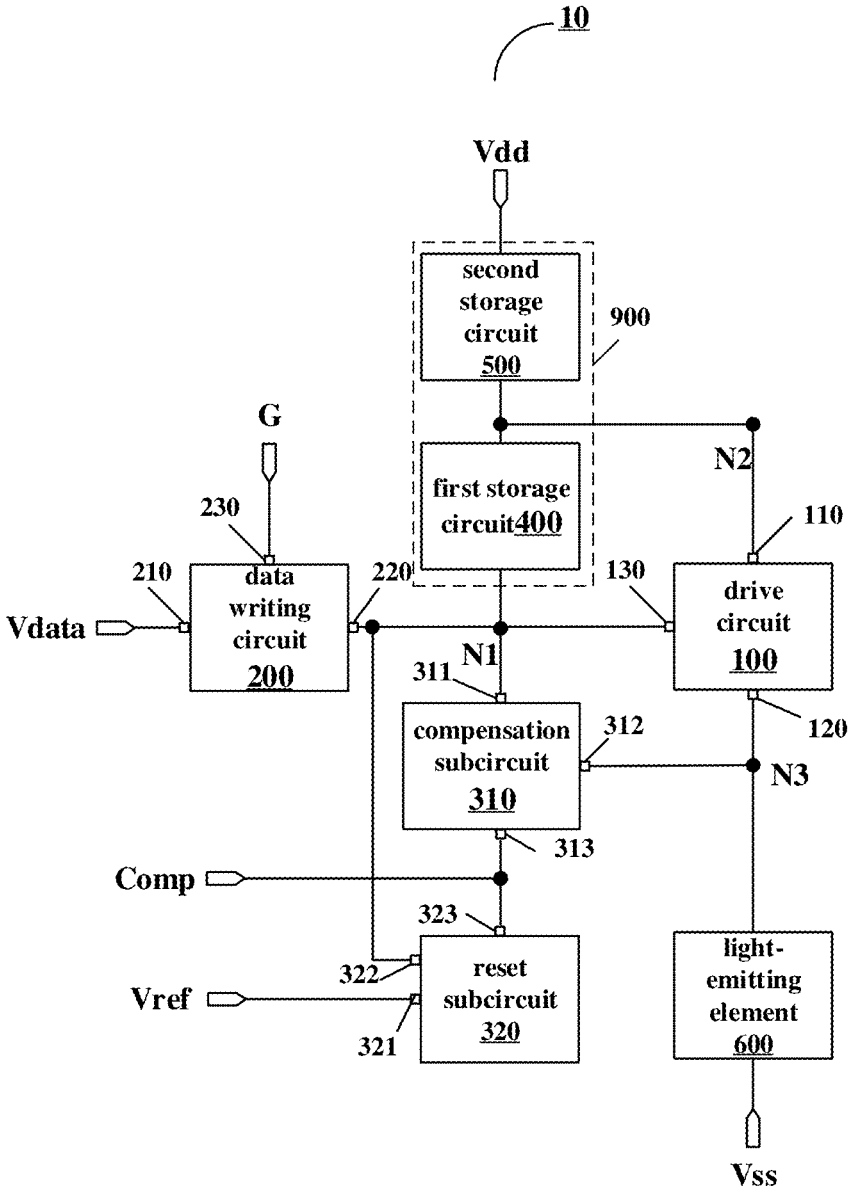
FIG. 4 is a schematic block diagram of yet another pixel circuit provided by an embodiment of the disclosure.

For example, the reset sub-circuit 320 includes a first terminal 321, a second terminal 322, and a control terminal 323, which are respectively connected to a reset voltage terminal Vref, a third node N3, and the compensation signal terminal Comp (the reset control line). For example, as shown in FIG. 4, the reset sub-circuit 320 may also be connected to the compensation signal terminal comp (the reset control line), the reset voltage terminal Vref, and the first node N1, respectively. For example, in an example, in the reset and compensation stage, the reset sub-circuit 320 may be turned on in response to the compensation signal, so that a reset voltage may be applied to the first node N1. For example, in another example, in a reset and compensation stage, the reset sub-circuit 320 may be turned on in response to the compensation signal, so that the reset voltage may be applied to the third node N3, and the reset voltage may be reapplied to the first node N1 through the compensation sub-circuit 310, so that the reset operation may be performed on the compensation sub-circuit 300, the first storage circuit 400, and the light-emitting element 600 to eliminate the influence of the previous light-emitting stage.

It should be noted that in the description of the embodiment of the present disclosure, the symbol Vdata can represent both the data signal terminal and a level of the data signal. Similarly, the symbol Vref can represent both the reset voltage terminal and the reset voltage, the symbol Vdd can represent both a first voltage terminal and a first voltage, and the symbol Vss can represent both the second voltage terminal and a second voltage. The following embodiments are the same and will not be described again.

For example, in a case where the drive circuit 100 is implemented as a drive transistor, for example, a gate electrode of the drive transistor may serve as the control terminal 130 (i.e., the first node N1) of the drive circuit 100, a first electrode (e.g., the source) may serve as the first terminal 110 (i.e., the second node N2) of the drive circuit 100, and a second electrode (e.g., the drain) may serve as the second terminal 120 (i.e., the third node N3) of the drive circuit 100.

For example, in a case where the reset voltage Vref is applied to the gate electrode of the drive transistor through the reset sub-circuit 320 while the source electrode of the drive transistor is in a floating state, a voltage $V_{GS}$ of the gate electrode of the drive transistor and the source electrode of the drive transistor can be satisfied: $|VGS|<|Vth|$ (Vth is the threshold voltage of the drive transistor, for example, Vth is negative value when the drive transistor is a P-type transistor), so that the drive transistor is in a cut-off state where $V_{GS}$ is a fixed bias. With the configuration, whether the data signal of the previous frame is a black signal or a white signal, the driving transistor starts to enter the data writing stage from a fixed off-bias state, for example, so that the problem of the short-term after image that may occur due to the hysteresis effect of the display device using the pixel circuit can be eliminated.

For example, the storage circuit 900 is configured to store the data signal that is wrote and the threshold voltage, and to couple and adjust a voltage of the control terminal 130 of the drive circuit 100. For example, the storage circuit 900 includes a first storage circuit 400 and a second storage circuit 500.

For example, the first storage circuit 400 is connected to the control terminal 130 of the drive circuit 100 and the first terminal 110 of the drive circuit 100, and is configured to store the data signal that is wrote, for example, in the data writing stage. For example, in a case where the first storage circuit 400 includes a storage capacitor, the first storage circuit 400 may store the information related to the threshold voltage of the drive circuit 100 into the storage capacitor accordingly in the compensation stage. For another example, in the data writing stage, the data writing circuit 200 may be turned on in response to the scanning signal, so that the data signal can be written and the data signal that is wrote can be stored in the first storage circuit 400, so that the drive circuit 100 can be controlled by using the stored voltage including the data signal and a voltage applied to the first electrode of the drive circuit during the light-emitting stage, for example, so that the drive circuit 100 can be compensated. For example, the specific process can be referred to the following description, which is not repeated here.

For example, the second storage circuit 500 is connected to the first voltage terminal Vdd and the first terminal 110 (i.e., the second node N2) of the drive circuit 100, and is configured to couple and adjust the voltage of the control terminal 130 (i.e., the first node N1) of the drive circuit 100. For example, in a case where the second storage circuit 500 includes a storage capacitor, when the voltage of the control terminal 130 (i.e., the first node N1) of the drive circuit 100 changes in the light-emitting stage, the second storage circuit 500 can couple and adjust the voltage of the control terminal 130 (i.e., the first node N1) of the drive circuit 100 according to a voltage variation of the second node N2 according to the characteristics of the storage capacitor of the second storage circuit 500, so that the value of the driving current for driving the light-emitting element 600 to emit light in the light-emitting stage can be adjusted.

The pixel circuit 10 provided by the embodiment of the present disclosure can not only eliminate the problem of the short-term after image possibly caused by the hysteresis effect of the display device including the pixel circuit, but also compensate the threshold voltage inside the drive circuit 100, so that the driving current driving the light-emitting element 600 is not affected by the threshold voltage, thereby improving the display effect of the display device including the pixel circuit and prolonging the service lifetime of the light-emitting element 600.

Figure 5:
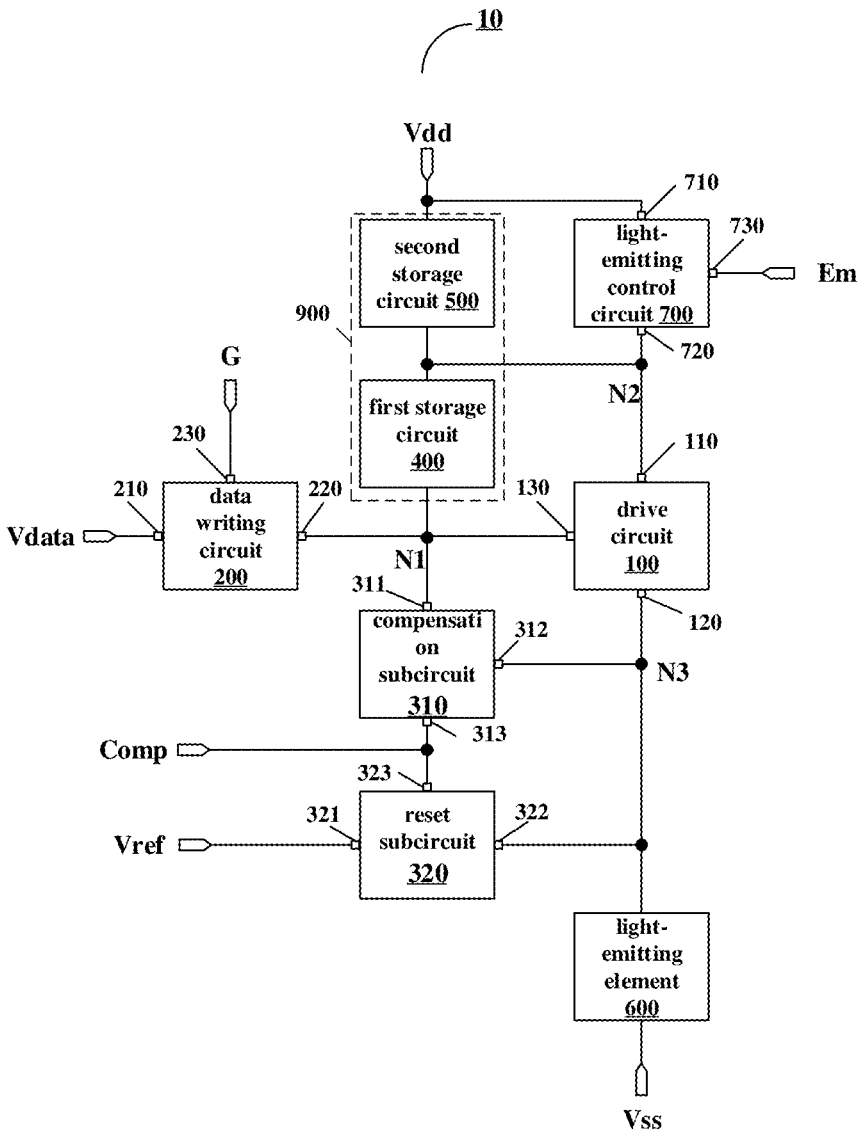
FIG. 5 is a schematic block diagram of yet another pixel circuit according to an embodiment of the present disclosure.

For example, as shown in FIG. 5, in another example of the embodiment, the pixel circuit 10 may further include a light-emitting control circuit 700.

For example, the light-emitting control circuit 700 includes a first terminal 710, a second terminal 720, and a control terminal 730, which are respectively connected to a first voltage terminal Vdd, a second node N2, and a light-emitting control line (light-emitting control terminal Em), and are configured to apply a first voltage to the second node N2 in response to a light-emitting control signal.

For example, in a light-emitting stage, the light-emitting control circuit 700 is turned on in response to the light-emitting control signal provided by a light-emitting control line (a light-emitting control terminal Em), so that the first voltage provided by the first voltage terminal Vdd can be applied to the first terminal 110 (i.e., the second node N2) of the drive circuit 100, and at the same time, the drive circuit 100 can apply the first voltage to the light-emitting element 600 to provide a drive voltage to drive the light-emitting element 600 to emit light.

It should be noted that in the embodiment of the present disclosure, the first voltage terminal Vdd, for example, continues to input a DC high level signal, and the DC high level is referred as the first voltage; the second voltage terminal Vss, for example, continues to input a DC low level signal, and the DC low level is referred as the second voltage, for example, the second voltage is smaller than the first voltage. The following embodiments are the same and will not be described again.

Figure 6:
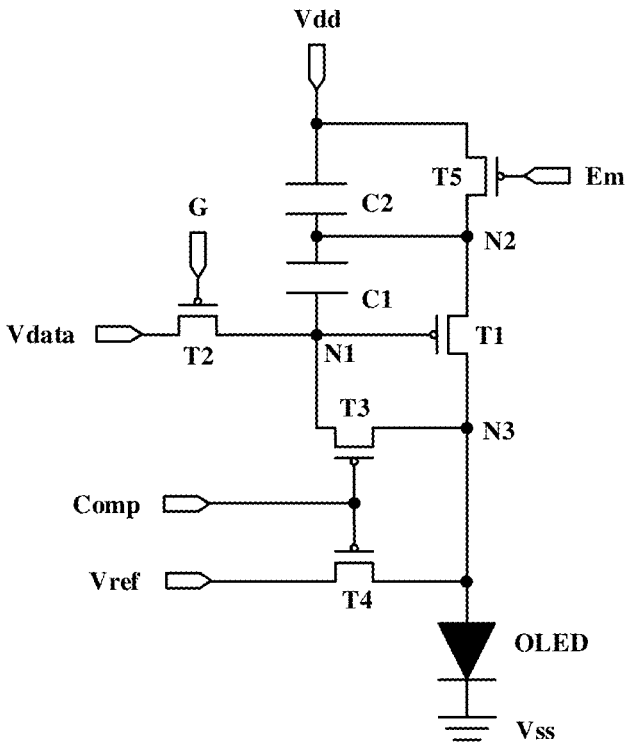
FIG. 6 is a circuit diagram of a specific implementation example of the pixel circuit as shown in FIG. 5.
Figure 7:
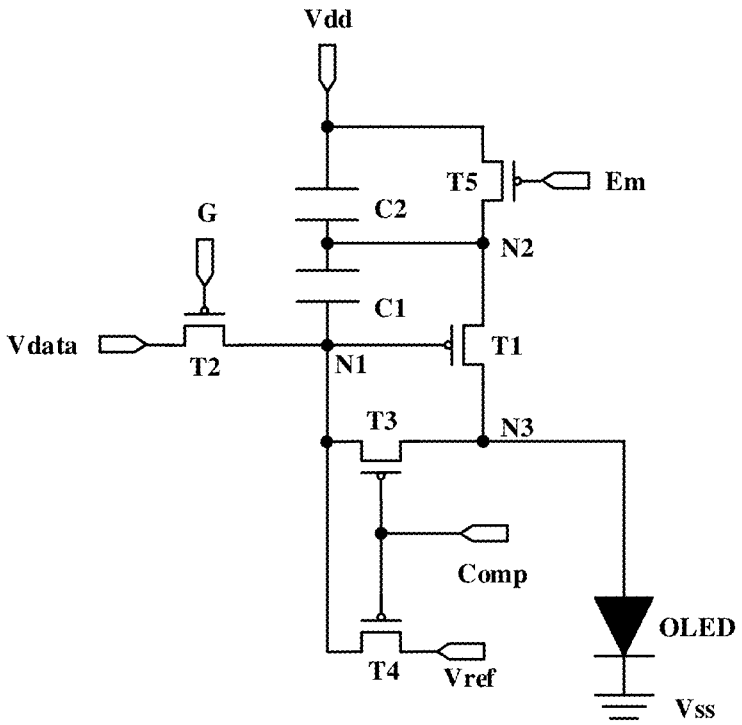
FIG. 7 is a circuit diagram of a specific implementation example of the pixel circuit as shown in FIG. 4.

For example, the pixel circuit 10 as shown in FIG. 5 may be implemented to the pixel circuit structure as shown in FIG. 6; the pixel circuit as shown in FIG. 4 may be implemented to the pixel circuit structure as shown in FIG. 7. As shown in FIG. 6 and FIG. 7, the pixel circuit 10 includes a first transistor to a fifth transistor T1, T2, T3, T4, T5 and an OLED, which includes a first storage capacitor C1 and a second storage capacitors C2 and a light-emitting element. For example, the first transistor T1 is used as a driving transistor, and the other second transistor to the fifth transistors are used as switching transistors. For example, the light-emitting element OLED may have various types, such as top emission, bottom emission, etc., and may emit red light, green light, blue light, white light, etc., and the embodiments of the present disclosure are not limited thereto.

For example, as shown in FIG. 6 and FIG. 7, in more detail, the drive circuit 100 may be implemented as a first transistor T1. A gate electrode of the first transistor T1 is connected to the first node N1 and serves as the control terminal 130 of the drive circuit 100, a first electrode of the first transistor T1 is connected to the second node N2 and serves as the first terminal 110 of the drive circuit 100, and a second electrode of the first transistor T1 is connected to the third node N3 and serves as the second terminal 120 of the drive circuit 100.

The data writing circuit 200 may be implemented as a second transistor T2. A gate electrode of the second transistor T2 is configured to be connected to a scan line (scan signal terminal G) to receive a scan signal as a control terminal 230 of the data writing circuit 200, a first electrode of the second transistor T2 is configured to be connected to a data line (data signal terminal Vdata) to receive a data signal as a first terminal 210 of the data writing circuit 200, and a second electrode of the second transistor T2 is connected to the first node N1 as a second terminal 220 of the data writing circuit 200.

The compensation sub-circuit 310 may be implemented as a third transistor T3. A gate electrode of the third transistor T3, as a control terminal 313 of the compensation sub-circuit 310, is configured to be connected to the compensation signal terminal Comp to receive the compensation signal, a first electrode of the third transistor T3 is connected to the first node N1 and serves as the first terminal 311 of the compensation sub-circuit 310, and a second electrode of the third transistor T3 is connected to the third node N3 as a second terminal 312 of the compensation sub-circuit 310.

The reset sub-circuit 320 may be implemented as a fourth transistor T4. A gate electrode of the fourth transistor T4, as a control terminal 323 of the reset sub-circuit 320, is configured to be connected to the compensation signal terminal Comp to receive the compensation signal, a first electrode of the fourth transistor T4, as the first terminal of the reset sub-circuit 320, is configured to be connected to the reset voltage terminal Vref to receive the reset voltage, and a second electrode of the fourth transistor T4 is connected to the third node N3 as a second terminal 322 of the reset sub-circuit 320, or as shown in FIG. 7, the second electrode of the fourth transistor T4 is connected to the first node N1 and serves as the second terminal 322 of the reset sub-circuit 320.

The first storage circuit 400 may be implemented as a first storage capacitor C1. A first electrode of the first storage capacitor C1 is connected to the first node N1, and a second electrode of the first storage capacitor C1 is connected to the second node N2.

The second storage circuit 500 may be implemented as a second storage capacitor C2. A first electrode of the second storage capacitor C2 is configured to be connected to the first voltage terminal Vdd to receive the first voltage, and a second electrode of the second storage capacitor C2 is connected to the second node N2.

The light-emitting control circuit 700 may be implemented as a fifth transistor T5. A gate electrode of the fifth transistor T5, as a control terminal 730 of the light-emitting control circuit 700, is configured to be connected to a light-emitting control line (a light-emitting control terminal Em) to receive the light-emitting control signal, a first electrode of the fifth transistor T5, as a first terminal 710 of the light-emitting control circuit 700, is configured to be connected to the first voltage terminal Vdd to receive the first voltage, and a second electrode of the fifth transistor T5, as a second terminal 720 of the light-emitting control circuit 700, is connected to the second node N2.

In the description of the present disclosure, the first node, the second node, and the third node do not represent actual components, but represent junction points of related electrical connections in the circuit diagram.

The number of transistors in the drive circuit of the pixel circuit 10 provided by the embodiment of the present disclosure can be reduced by two compared with the number of transistors in the drive circuit of the OLED display device in current mass production, thus the pixel circuit 10 can be applicable to the design of display devices with high pixels.

Figure 8:
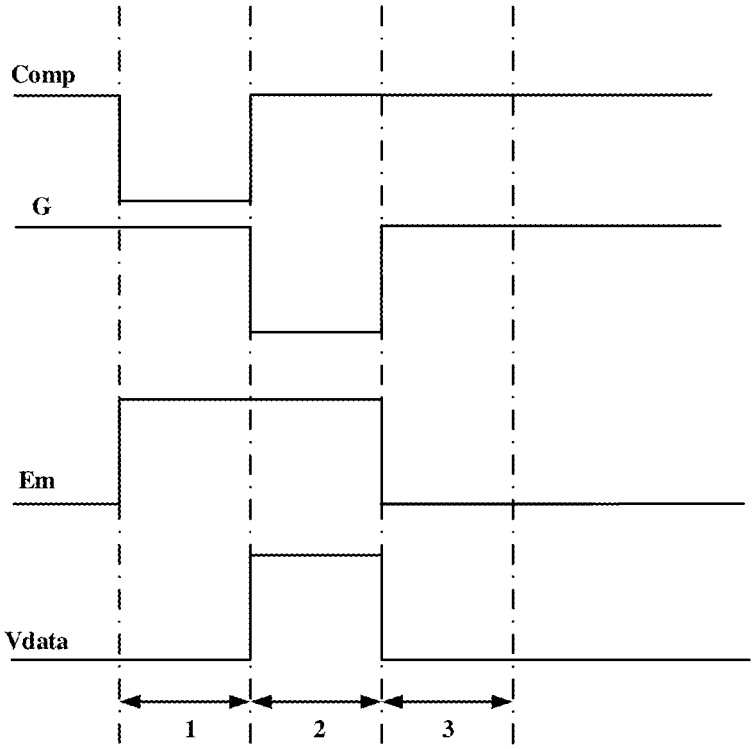
FIG. 8 is a timing chart of a driving method provided by an embodiment of the disclosure.

The operation principle of the pixel circuit 10 as shown in FIG. 6 can be described below with reference to a signal timing chart as shown in FIG. 8, and each transistor is a P-type transistor as an example, but the embodiment of the present disclosure is not limited thereto.

As shown in FIG. 8, three stages are included, namely a reset and compensation stage 1, a data writing stage 2 and a light-emitting stage 3. The timing waveform of each signal in each stage is shown in the figure.

Figure 9:
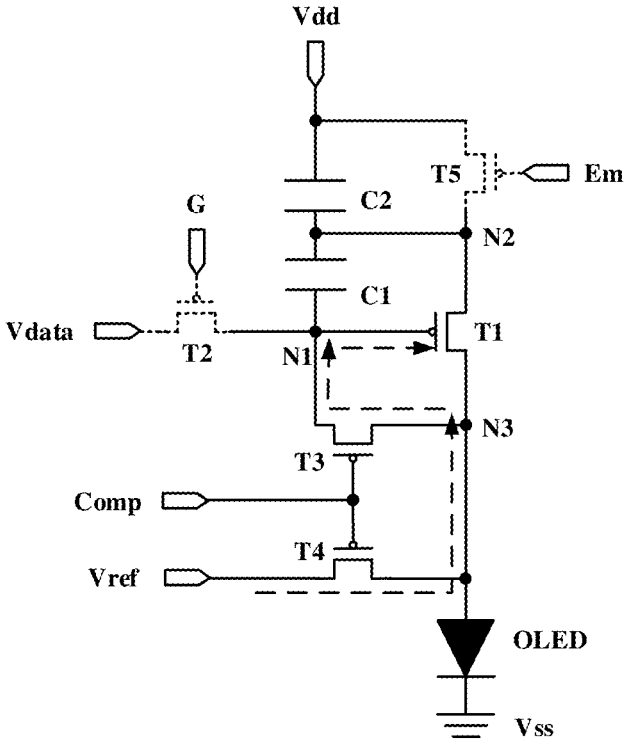
FIG. 9 to FIG. 11 are circuit diagrams of the pixel circuit as shown in FIG. 6 corresponding to the three stages in FIG. 8, respectively.
Figure 10:
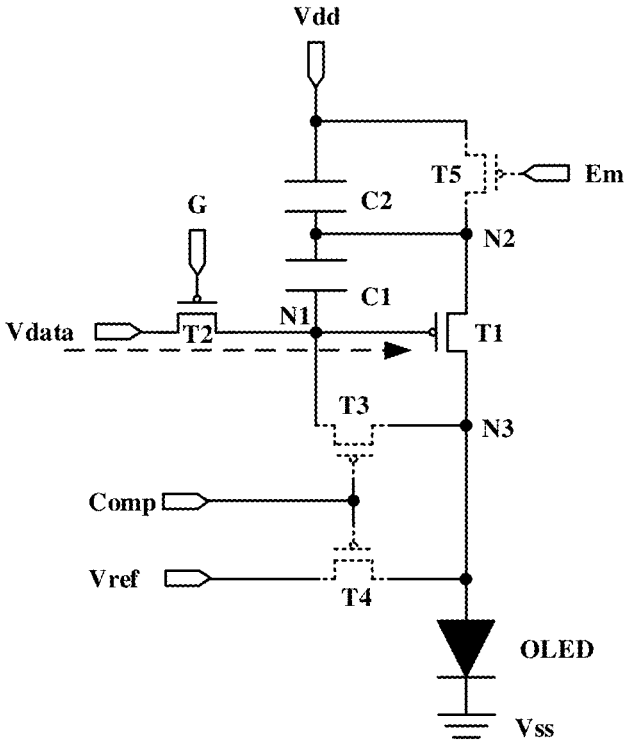
Figure 11:
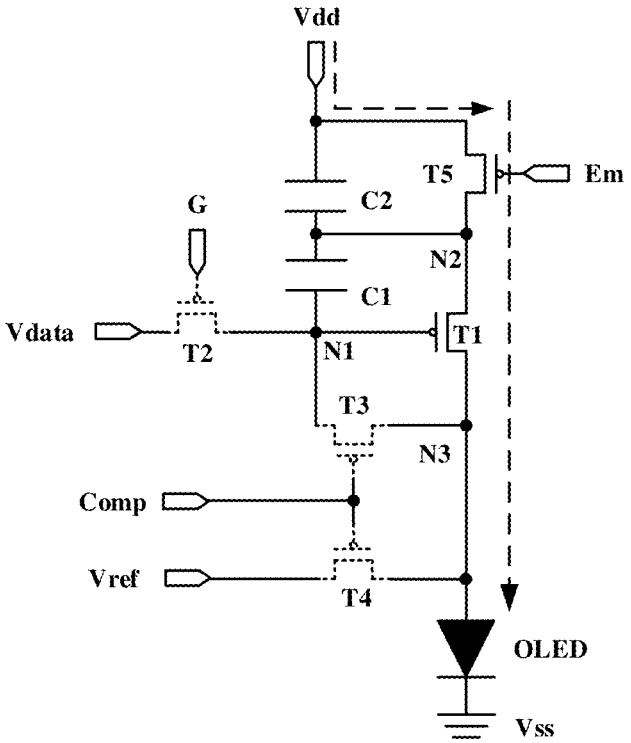

It should be noted that FIG. 9 is a schematic diagram in a case where the pixel circuit as shown in FIG. 6 is in the reset and compensation stage 1, FIG. 10 is a schematic diagram in a case where the pixel circuit as shown in FIG. 6 is in the data writing stage 2, and FIG. 11 is a schematic diagram in a case where the pixel circuit as shown in FIG. 6 is in the light-emitting stage 3. In addition, the transistors identified by dashed lines in FIG. 9 to FIG. 11 all indicate that the transistors are in a turn-off state in the corresponding stage, and the dashed lines with arrows in FIG. 9 to FIG. 11 indicate a current direction of the pixel circuit in the corresponding stage. The transistors as shown in FIG. 9 to FIG. 11 are all explained by taking a P-type transistor as an example, i.e., a gate electrode of each transistor are turned on in a case where a low level is applied and turned off in a case where a high level is applied.

In the reset and compensation stage 1, a compensation signal is input, the compensation-and-reset circuit 300 is turned on, the first storage circuit 400 is reset, and the drive circuit 100 is compensated so that the drive circuit 100 is at a fixed off-bias state.

As shown in FIG. 8 and FIG. 9, in the reset and compensation stage 1, the third transistor T3 and the fourth transistor T4 are turned on by a low level of the compensation signal. Also, the second transistor T2 is turned off by a high level of the scanning signal, and the fifth transistor T5 is turned off by a high level of the light-emitting control signal.

As shown in FIG. 9, in the reset and compensation stage 1, a reset and compensation path is formed (as shown by the dotted lines with arrows in FIG. 9), the first storage capacitor C1, the second storage capacitor C2, and the light-emitting element OLED are discharged through the fourth transistor T4, thereby resetting the first node N1, so a potential of the first node N1 after the reset and compensation stage 1 is a reset voltage Vref (a low level signal, such as a grounded level or other low level signal). Also, the second node N2 is in a floating state before entering the reset and compensation stage, in the reset and compensation stage 1, a potential of the second node N2 starts discharging from the first voltage provided by the first voltage terminal Vdd until a potential of the second node N2 is discharged to Vref-Vth (i.e., the threshold voltage Vth is written into the first storage capacitor C1). It is easy to be understood that in the reset and compensation stage, the potential of the first node N1 is the reset voltage Vref, and also, according to the own characteristics of the first transistor T1, when the potential of the second node N2 is discharged to Vref-Vth, the first transistor T1 is turned off and the discharge process is finished. Therefore, in the reset and compensation stage, the voltage $V_{GS}$ of the gate electrode (i.e., the first node N1) and the source electrode (i.e., the second node N2) of the first transistor T1 can be satisfied: |VGS|<|Vth| (Vth is the threshold voltage of the first transistor T1, for example, Vth is negative value when the first transistor T1 is a P-type transistor), so that the first transistor T1 is in a turn-off state in a case where $V_{GS}$ is fixed bias. With the configuration, whether the data signal Vdata of the previous frame is a black signal or a white signal, the first transistor T1 starts to enter the data writing stage 2 from the fixed off-bias state, thereby eliminating the problem of the short-term after image that may occur due to the hysteresis effect of the display device using the pixel circuit 10.

After the reset and compensation stage 1, the potential of the first node N1 is the reset voltage Vref and the potential of the second node N2 is Vref-Vth, that is, the voltage information with the threshold voltage Vth is stored in the first storage capacitor C1 for compensating the threshold voltage of the first transistor T1 itself in the light-emitting stage.

In the reset and compensation stage 1, the first storage capacitor C1 is reset to discharge the voltage stored into the first storage capacitor C1, so that data signal in subsequent stages can be stored into the first storage capacitor C1 more quickly and reliably. Also, the third node N3 is also reset, that is, the light-emitting element OLED is reset, so that the light-emitting element OLED can be displayed in a black state without emitting light before the light-emitting stage 3, and display effects such as the contrast of a display device using the pixel circuit are improved.

In the data writing stage 2, a scanning signal and a data signal are input, and the data writing circuit 200 is turned on. The data writing circuit 200 writes the data signal into the first storage circuit 400. The second storage circuit 500 couples and adjusts the voltage of the first terminal 110 (the second node N2) of the drive circuit 100 according to the voltage variation of the control terminal 130 (the first node N1) of the drive circuit 100.

As shown in FIG. 8 and FIG. 10, in the data writing sage 2, the second transistor T2 is turned on by a low level of the scanning signal. Also, the third transistor T3 and the fourth transistor T4 are turned off by a high level of the compensation signal, and the fifth transistor T5 is turned off by a high level of the light-emitting control signal.

As shown in FIG. 10, in the data writing stage 2, a data writing path (as shown by a dotted line with an arrow in FIG. 10) is formed, the data signal charges the first node N1 through the second transistor T2, so that the potential of the first node N1 changes from the reset voltage Vref to the level Vdata of the data signal. Due to the characteristics of the capacitor, a change of the potential of one terminal of the first storage capacitor C1, i.e., the first node N1, will cause a change of the other terminal of the first storage capacitor C1, i.e., the second node N2. Also, because the first storage capacitor C1 and the second storage capacitor C2 are connected in series according to the principle of charge conservation, the potential of the second node N2 can be changed to Vref−Vth+(Vdata−Vref)*C1/(C1+C2).

After the data writing stage 2, the potential of the first node N1 is the level Vdata of the data signal, and the potential of the second node N2 is Vref−Vth+(Vdata−Vref) *C1/(C1+C2), that is, the voltage information with the data signal Vdata is stored into the first storage capacitor C1 for providing gray-scale display data in the light-emitting stage.

In the light-emitting stage 3, a light-emitting control signal is input, and the light-emitting control circuit 700 and the drive circuit 100 are turned on. The second storage circuit 500 couples and adjusts the voltage of the first node N1 according to the voltage variation of the second node N2. The light-emitting control circuit 700 applies a driving current to the light-emitting element 600 to drive the light-emitting element 600 to emit light.

As shown in FIG. 8 and FIG. 11, in the light-emitting stage 3, the fifth transistor T5 is turned on by a low level of the light-emitting control signal; also, the second transistor T2 is turned off by a high level of the scanning signal, and the third transistor T3 and the fourth transistor T4 are turned off by a high level of the compensation signal.

As shown in FIG. 11, in the light-emitting stage 3, a driving light-emitting path (as shown by the dotted line with an arrow in FIG. 11) is formed. The light-emitting element OLED can emit light under the control of the driving current flowing through the first transistor T1. As shown in FIG. 11, at the light-emitting stage, the first voltage charges the second node N2 through the fifth transistor T5, so that the potential of the second node N2 changes from Vref−Vth+(Vdata−Vref)*C1/(C1+C2) to the first voltage Vdd. Due to the characteristics of the capacitor, a change of the potential of one terminal of the first storage capacitor C1, i.e., the second node N2, will cause a change of the another terminal of the first storage capacitor C1, i.e., the first storage capacitor N1. Also, because the first storage capacitor C1 and the second storage capacitor C2 are connected in series, according to the principle of charge conservation, the potential of the first node N1 can be changed to Vdata+(Vdd−(Vref−Vth+(Vdata−Vref)*C1/(C1+C2)).

Specifically, the value of the driving current $I_{OLED}$ flowing through the light-emitting element OLED can be obtained according to the following formula:

$$I_{OLED}=\tfrac{1}{2}*K*(Vgs-Vth)^2,$$

where $k=w*Cox*U/L$.

The following values is given:

$$Vg=V_{N1}=V\text{data}+(Vdd-(V\text{ref}-Vth+(V\text{data}-V\text{ref})*C1/(C1+C2))),$$

$$Vs=V_{N2}=Vdd.$$

The following formula can be obtained by substituting the above values:

$$I_{OLED}=\tfrac{1}{2}*K*((V\text{data}-V\text{ref})*C2/(C1+C2))^2,$$

where $K=W*Cox*U/L$.

In the above formula, Vth represents the threshold voltage of the first transistor T1, Vgs represents the voltage between the gate electrode and the source electrode (here, the first electrode) of the first transistor T1, $V_{N1}$ represents the potential of the first node N1, $V_{N2}$ represents the potential of the second node N2, and K is a constant value related to the drive transistor. From the above calculation formula of $I_{OLED}$, it can be seen that the driving current $I_{OLED}$ flowing through the light-emitting element OLED is no longer related to the threshold voltage Vth of the first transistor T1, thus the compensation for the pixel circuit can be realized, the problem of threshold voltage drift of the drive transistor (the first transistor T1 in the embodiment of the present disclosure) due to process and long-term operation is solved, and the display unevenness caused by the influence of the threshold voltage drift on the driving current $I_{OLED}$ is eliminated. It can also be seen that the driving current $I_{OLED}$ flowing through the light-emitting element OLED is no longer related to the first voltage Vdd, thus solving the problem of uneven display of the display panel, which is caused by deviation of the first voltage Vdd caused by voltage drop of the power supply line. The pixel circuit according to the embodiment of the present disclosure can improve the display effect of the display device using the pixel circuit.

In addition, the sizes of the first storage capacitor C1 and the second storage capacitor C2 can be selected, for example, such that the capacitance value C2 is much larger than the capacitance value C1, then the above calculation formula can be simplified as:

$$I_{OLED}\approx\tfrac{1}{2}*K*(V\text{data}-V\text{ref})^2$$

Therefore, it can be seen that the driving current $I_{OLED}$ flowing through the light-emitting element OLED is no longer related to the specific values of the capacitance values C1 and C2, so that the influence of the fluctuation of the capacitance value on the driving current caused by the manufacturing process of the first storage capacitor C1 and the second storage capacitor C2 can be overcome, and the display effect of the display device using the pixel circuit can be further improved.

It should be noted that the transistors used in the embodiments of the present disclosure can be thin film transistors or field effect transistors or other switching devices with the same characteristics, and the embodiments of the present disclosure are all described with the thin film transistors as examples. The source electrode of the transistor and drain electrode of the transistor used here can be symmetrical in structure, so the source electrode of the transistor and drain electrode of the transistor can be structurally indistinguishable. In the embodiment of the present disclosure, in order to distinguish the two electrodes of the transistor except the gate electrode, one electrode is directly described as the first electrode and the other electrode is described as the second electrode.

In addition, it should be noted that the transistors in the pixel circuit 10 as shown in FIG. 6 are all explained by taking a P-type transistor as an example. In the case, the first electrode may be a drain electrode and the second electrode may be a source electrode. As shown in FIG. 6, a cathode of the light-emitting element OLED in the pixel circuit 10 is connected to the second voltage terminal Vss to receive the second voltage. For example, in a display device, when the pixel circuits 10 as shown in FIG. 6 are arranged in an array, the cathodes of the light-emitting elements OLED can be electrically connected to the same voltage terminal, i.e., a common cathode connection mode is adopted.

Figure 12:
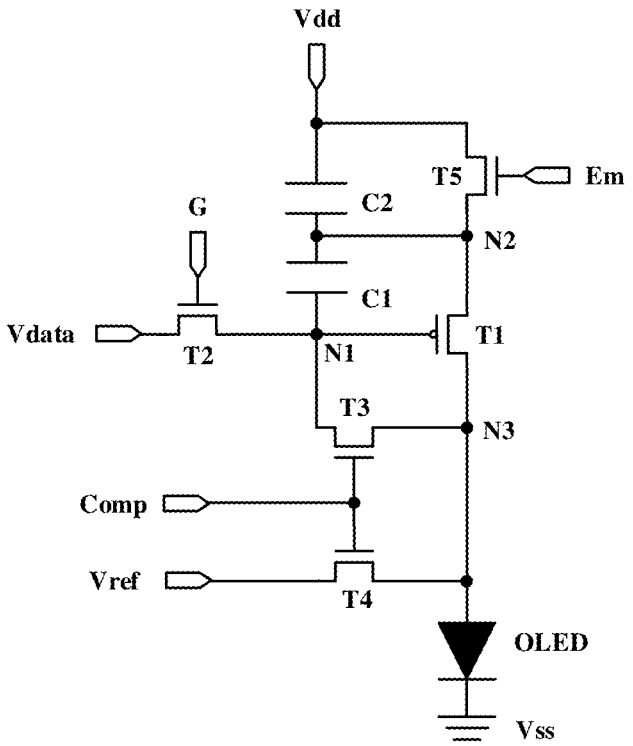
FIG. 12 is a circuit diagram of a pixel circuit according to an embodiment of the present disclosure.

The embodiment of the present disclosure includes but is not limited to the configuration mode as shown in FIG. 6. for example, as shown in FIG. 12, in another embodiment of the present disclosure, the transistors in the pixel circuit 10 can also be mixed with P-type transistors and N-type transistors, and only the port polarities of the selected types of transistors need to be connected correspondingly according to the port polarities of the corresponding transistors in the embodiment of the present disclosure. For example, as shown in FIG. 12, the first transistor T1 adopts a P-type transistor and the second transistor T2, the third transistor T3, the fourth transistor T4 and the fifth transistor T5 adopt an N-type transistor. It should be noted that at this time, the signal levels supplied to the second transistor T2, the third transistor T3 and the fourth transistor T4 need to be changed to a high level accordingly.

Figure 13:
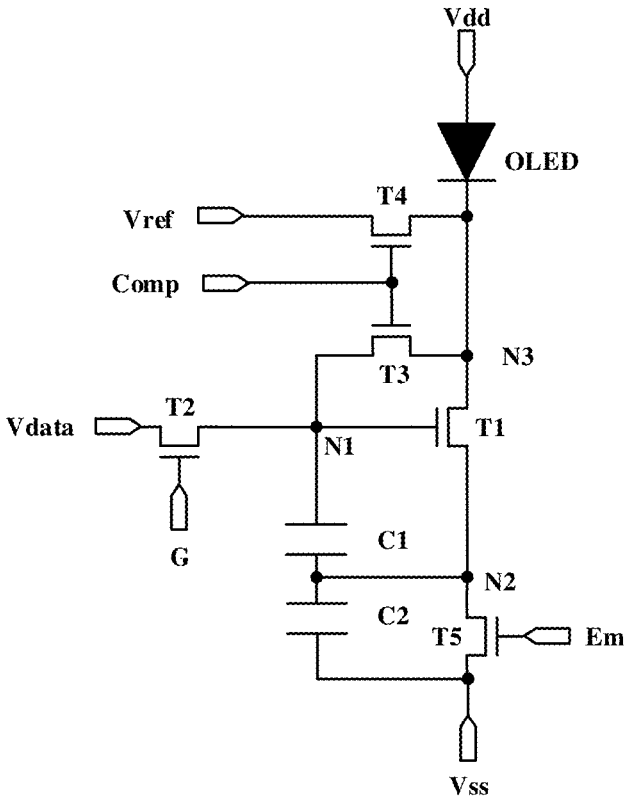
FIG. 13 is a circuit diagram of another pixel circuit according to an embodiment of the present disclosure.

For example, as shown in FIG. 13, in yet another embodiment of the present disclosure, transistors in the pixel circuit 10 may all adopt N-type transistors, where the first electrode may be a source electrode and the second electrode may be a drain electrode. In this embodiment, an anode of the light-emitting element OLED in the pixel circuit 10 is connected to the first voltage terminal Vdd to receive the first voltage. For example, in a display device, when the pixel circuits 10 as shown in FIG. 13 are arranged in an array, the anodes of the light-emitting elements OLED can be electrically connected to the same voltage terminal (e.g., common voltage terminal), i.e., a common anode connection mode is adopted.

It should be noted that, in the embodiment of the present disclosure, when the driving transistor, i.e., the first transistor T1, is an N-type transistor, it can be manufactured using an IGZO (Indium Gallium Zinc Oxide) manufacturing process, which can effectively reduce the size of the driving transistor and prevent the occurrence of leakage current compared with the LTPS (Low Temperature Poly Silicon) manufacturing process.

Figure 14:
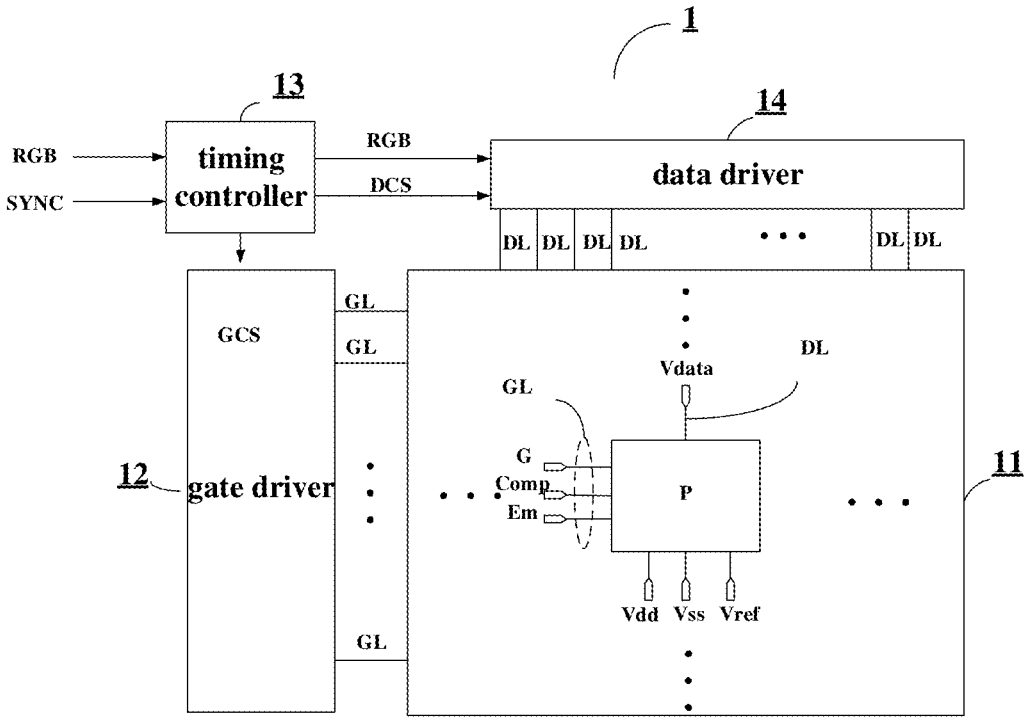
FIG. 14 is a schematic diagram of a display device according to an embodiment of the present disclosure.

An embodiment of the present disclosure also provides a display device 1, as shown in FIG. 14, the display device 1 includes a plurality of pixel units P including any of the pixel circuits 10 provided in the above embodiment and light-emitting elements. For example, the pixel circuit 10 as shown in FIG. 6 is included. As shown in FIG. 14, the display device 1 further includes a plurality of scanning lines GL and a plurality of data lines DL. It should be noted that only a portion of the pixel units P, scan lines GL, and data lines DL are shown in FIG. 14.

For example, in an example, the plurality of pixel units P are arranged in a plurality of rows, control terminals of data writing circuits 200 of pixel circuits 10 of pixel units P in a row are connected to the same scanning line GL to provide scanning signals to the data writing circuit 200, and control terminals of compensation-and-reset circuits 300 of the pixel circuits 10 of the pixel units P in the row are connected to another scanning line GL to provide compensation signals to the compensation-and-reset circuits 300. For example, the another scanning line GL is also connected to control terminals of data writing circuits 200 of pixel circuits 10 of pixel units P in a previous row. For example, the data line DL in each column is connected to first terminals (input terminals) of data writing circuits 200 in the pixel circuits 10 in the column to provide a data signal.

Also for example, in another example, the display device 1 may further include a plurality of reset control lines. For example, a plurality of pixel units P are arranged in a plurality of rows, the control terminals of the data writing circuits 200 of the pixel circuits 10 of the pixel units P in a row are connected to a same scanning line, and the control terminals of the compensation-and-reset circuits 300 of the pixel circuits 10 of the pixel units P in a row are connected to a same reset control line (the compensation signal terminal Comp).

For example, in a case where the pixel circuit 10 includes the light-emitting control circuit 700, the display device 1 may further include a plurality of light-emitting control lines.

For example, the light-emitting control circuit 700 includes a control terminal, a first terminal, and a second terminal, which are respectively connected to a light-emitting control line (a light-emitting control terminal Em), a first voltage terminal Vdd, and a second node N2, and configured to apply the first voltage Vdd to the second node N2 in response to a light-emitting control signal. For example, the light-emitting control line in each row is connected to the light-emitting control terminal Em of the pixel circuits in a row (i.e., connected to the light-emitting control circuit 700) to provide a light-emitting control signal.

It should be noted that the display device 1 as shown in FIG. 14 may further include a plurality of first voltage lines, second voltage lines, and a plurality of reset voltage lines to provide a first voltage, a second voltage, and a reset voltage, respectively.

For example, as shown in FIG. 14, the display device 1 may further include a display panel 11, a gate driver 12, a data driver 14, and a timing controller 13. The display panel 11 includes a plurality of pixel units P defined by a plurality of scanning lines GL and a plurality of data lines DL which is crossed with the plurality of scanning lines GL; the gate driver 12 is used to drive a plurality of scan lines GL; the data driver 14 is used to drive a plurality of data lines DL; and the timing controller 13 is used to process image data RGB input from the outside of the display device 1, supply a processed image data RGB to the data driver 14, and outputting a scan control signal GCS and a data control signal DCS to the gate driver 12 and the data driver 14 to control the gate driver 12 and the data driver 14.

As shown in FIG. 12, the display panel 11 includes the plurality of scanning lines GL and the plurality of data lines DL which is intersected with the plurality of scanning lines GL. The pixel unit P is disposed in an intersection region of the scanning line GL and the data line DL. For example, each pixel unit P is connected to three scanning lines GL (providing the scanning signal, the compensation signal, and the light-emitting control signal), one data line DL, the first voltage line for providing the first voltage, the second voltage line for providing the second voltage, and the reset voltage line for providing the reset voltage. Also, the first voltage line or the second voltage line here may be replaced with a corresponding plate-shaped common electrode (e.g., a common anode or a common cathode).

For example, the gate driver 12 supplies a plurality of strobe signals to the plurality of scanning lines GL according to a plurality of scan control signals GCS originating from the timing controller 13. The plurality of strobe signals include a scan signal, a light-emitting control signal, and a compensation signal. These signals are supplied to each pixel unit P through the plurality of scanning lines GL.

For example, the data driver 14 converts the digital image data RGB input from the timing controller 13 into the data signal according to a plurality of data control signals DCS originating from the timing controller 13 using a reference gamma voltage. The data driver 14 supplies converted data signals to the plurality of data lines DL.

For example, the timing controller 13 sets externally input image data RGB to match the size and resolution of the display panel 11, and then supplies the set image data to the data driver 14. The timing controller 13 generates the plurality of scan control signals GCS and the plurality of data control signals DCS using synchronization signals (e.g., a dot clock DCLK, a data enable signal DE, a horizontal synchronization signal Hsync, and a vertical synchronization signal Vsync) input from outside the display device. The timing controller 13 supplies the generated scan control signal GCS and the data control signal DCS to the gate driver 12 and the data driver 14, respectively, for controlling the gate driver 12 and the data driver 14.

For example, the data driver 14 may be connected to the plurality of data lines DL to provide a data signal Vdata; also, it can also be connected to a plurality of first voltage lines, a plurality of second voltage lines and a plurality of reset voltage lines to provide a first voltage, a second voltage and a reset voltage, respectively.

For example, the gate driver 12 and the data driver 13 may be implemented as semiconductor chips. The display device 1 may also include other components, such as a signal decoding circuit, a voltage conversion circuit, etc. These components may, for example, adopt conventional components, which will not be described in detail here.

The progressive scanning process of the display device 1 will be described below in connection with the description of the operation principle of the pixel circuit 10 as shown in FIG. 6 in the above-mentioned embodiment, and the corresponding description in the above-mentioned embodiment may be referred to in various stages in this embodiment.

For example, pixel circuits in an N-th row receive the scan signal on the scan line in an (N−1)-th row and enter the reset and compensation stage. At the reset and compensation stage, threshold voltages Vth of drive transistors (T1) in the pixel circuits of the pixel units in the N-th row are written into the first storage circuits for compensating the threshold voltage Vth in the subsequent light-emitting stage.

The pixel circuits in the N-th row enters the data writing stage after passing through the reset and compensation stage. In the data writing stage, the data signal Vdata is written into the pixel circuits in the N-th row for providing corresponding gray scale display data in the subsequent light-emitting stage. At this time, pixel circuits in an (N+1)-th row are in the reset and compensation stage, and corresponding threshold voltages Vth are written into the pixel circuits in the (N+1)-th row.

The pixel circuits in the N-th row enters the light-emitting stage after passing through the data writing stage, and light-emitting control circuits 700 in the pixel circuits in the N-th row are turned on by receiving a turned-on signal provided by the light-emitting control line in the N-th row, so that the pixel circuits in the N-th row realizes light-emitting display. At the same time, the pixel circuits in the (N+1)-th row are in the data writing stage, and the corresponding data signal Vdata is written into the pixel circuits in the (N+1)-th row. At the next moment, the light-emitting control circuits 700 of the pixel circuits in the (N+1)-th row is received to a turned-on signal provided by the light-emitting control line in the (N+1)-th row and turned on to realize light-emitting display, and so on, thus realizing progressive scanning display.

The technical effect of the display device 1 can be, referred to the technical effect of the pixel circuit 10 provided in the embodiments of the present disclosure, which will not be repeated here.

For example, the display device 1 provided in this embodiment may be any product or component with display function such as electronic paper, mobile phone, tablet computer, television, display, notebook computer, digital photo frame, navigator, etc.

An embodiment of the present disclosure also provides a driving method that can be used to drive the pixel circuit 10 provided by the embodiment of the present disclosure. For example, the driving method includes the following operations.

In a reset and compensation stage, a compensation signal is input, the compensation-and-reset circuit 300 is turned on, the first storage circuit 400 is reset, and the drive circuit 100 is compensated so that the drive circuit 100 is in a fixed off-bias state;

In a data writing stage, a scanning signal and a data signal are input, and the data writing circuit 200 is turned on. The data writing circuit 200 writes the data signal into the first storage circuit 400. The second storage circuit 500 couples and adjusts the voltage of the second node N2 according to the voltage variation of the first node N1.

For example, in an example (excluding the light-emitting control circuit), in the light-emitting stage, a driving current is applied to the light-emitting element 600 to cause it to emit light. For example, in another example (including the light-emitting control circuit 700), in the light-emitting stage, a light-emitting control signal is input, the light-emitting control circuit 700 and the drive circuit 100 are turned on, the second storage circuit 500 couples and adjusts the voltage of the first node N1 according to the voltage variation of the second node N2, and the light-emitting control circuit 700 applies a driving current to the light-emitting element 600 to drive the light-emitting element 600 to emit light.

The driving method provided in this embodiment can eliminate the problem of the short-term after image that may occur due to the hysteresis effect, and can also compensate the threshold voltage of the drive circuit, for example, to avoid uneven display, thereby improving the display effect of the display device using the pixel circuit.

The above description is only a specific embodiment of the present disclosure, but the scope of protection of the present disclosure is not limited thereto, and the scope of protection of the present disclosure shall be subject to the scope of protection of the claims.

What is claimed is:

1. A pixel circuit, comprising a drive circuit, a data writing circuit, a compensation-and-reset circuit, a light-emitting control circuit, and a storage circuit, wherein the drive circuit comprises a control terminal, a first terminal and a second terminal, and is configured to control a driving current for driving a light-emitting element to emit light;

the data writing circuit is connected to the control terminal of the drive circuit and configured to write a data signal to the control terminal of the drive circuit in response to a scanning signal;

the compensation-and-reset circuit is connected to the control terminal of the drive circuit and a reset voltage terminal, and is configured to electrically connect the control terminal of the drive circuit and the second terminal of the drive circuit and apply a reset voltage to the control terminal of the drive circuit in response to a compensation signal; and the storage circuit is configured to store the data signal that is wrote and a threshold voltage, and to couple and adjust a voltage of the control terminal of the drive circuit, wherein the storage circuit comprises a first storage circuit and a second storage circuit;

the first storage circuit is connected to the control terminal of the drive circuit and the first terminal of the drive circuit, and configured to store the data signal that is wrote;

the second storage circuit is connected to a first voltage terminal and the first terminal of the drive circuit, and is configured to couple and adjust the voltage of the control terminal of the drive circuit;

the first storage circuit comprises a first storage capacitor, and the second storage circuit comprises a second storage capacitor;

a capacitance value of the second storage capacitor is larger than a capacitance value of the first storage capacitor, and a value of a driving current $I_{OLED}$ flowing through the light-emitting element is obtained according to a following formula:

$$I_{OLED} \approx \frac{1}{2} * K * (V\text{data} - V\text{ref})^2,$$

where K=W*Cox*U/L, Vref represents a reset voltage, and Vdata represents a voltage of the data signal;

the compensation-and-reset circuit comprises a compensation sub-circuit and a reset sub-circuit, wherein the compensation sub-circuit comprises a control terminal, a first terminal and a second terminal, which are respectively connected to the compensation signal terminal, a first node and a third node, and the reset sub-circuit comprises a control terminal, a first terminal and a second terminal, which are respectively connected to the compensation signal terminal, the reset voltage terminal and the first node; and the light-emitting control circuit comprises a control terminal, a first terminal, and a second terminal, which are connected to a light-emitting control line, the first voltage terminal, and the first terminal of the drive circuit, respectively, and configured to apply a first voltage to the first terminal of the drive circuit in response to a light-emitting control signal, wherein during a display period of the pixel circuit, the light-emitting control signal holds an inactive level at a reset and compensation stage and a data writing stage and holds an active level at a light-emitting stage and a stage subsequent to the light-emitting stage, the compensation signal holds an active level at the reset and compensation stage and holds an inactive level at other stages, and the scanning signal holds an active level at the data writing stage and holds an inactive level at other stages.

2. The pixel circuit according to claim 1, wherein the control terminal of the drive circuit is connected to the first node, the first terminal of the drive circuit is connected to a second node, and the second terminal of the drive circuit is connected to the third node;

the data writing circuit comprises a control terminal, a first terminal and a second terminal, which are respectively connected to a scanning line, a data line and the first node;

the compensation-and-reset circuit is connected to a compensation signal terminal, the reset voltage terminal, the first node and the third node; and the light-emitting element is connected to the third node and a second voltage terminal.

3. The pixel circuit according to claim 2, wherein the drive circuit comprises a first transistor;

a gate electrode of the first transistor is connected to the first node and serves as the control terminal of the drive circuit, a first electrode of the first transistor is connected to the second node and serves as the first terminal of the drive circuit, and a second electrode of the first transistor is connected to the third node and serves as the second terminal of the drive circuit.

4. The pixel circuit according to claim 2, wherein the data writing circuit comprises a second transistor;

a gate electrode of the second transistor, as the control terminal of the data writing circuit, is configured to be connected to the scanning line to receive the scanning signal, a first electrode of the second transistor, as the first terminal of the data writing circuit, is configured to be connected to the data line to receive the data signal, and a second electrode of the second transistor, as the second terminal of the data writing circuit, is connected to the first node.

5. The pixel circuit according to claim 1, wherein the compensation sub-circuit comprises a third transistor;

a gate electrode of the third transistor is configured to be connected to the compensation signal terminal to receive the compensation signal and serves as the control terminal of the compensation sub-circuit, a first electrode of the third transistor is connected to the first node and serves as the first terminal of the compensation sub-circuit, and a second electrode of the third transistor is connected to the third node and serves as the second terminal of the compensation sub-circuit.

6. The pixel circuit according to claim 2, wherein a first electrode of the first storage capacitor is connected to the first node, and a second electrode of the first storage capacitor is connected to the second node.

7. The pixel circuit according to claim 2, wherein a first electrode of the second storage capacitor is configured to be connected to the first voltage terminal to receive a first voltage, and a second electrode of the second storage capacitor is connected to the second node.

8. The pixel circuit according to claim 1, wherein the reset sub-circuit comprises a fourth transistor;

a gate electrode of the fourth transistor is configured to be connected to the compensation signal terminal to receive the compensation signal and serves as the control terminal of the reset sub-circuit, a first electrode of the fourth transistor is configured and connected to the reset voltage terminal to receive the reset voltage and serves as the first terminal of the reset sub-circuit, and a second electrode of the fourth transistor is connected to the first node and serves as the second terminal of the reset sub-circuit.

9. The pixel circuit according to claim 2, wherein the light-emitting control circuit comprises a fifth transistor;

a gate electrode of the fifth transistor, as the control terminal of the light-emitting control circuit, is configured to be connected to the light-emitting control line to receive the light-emitting control signal, a first electrode of the fifth transistor, as the first terminal of the light-emitting control circuit, is configured to be connected to the first voltage terminal to receive the first voltage, and a second electrode of the fifth transistor, as the second terminal of the light-emitting control circuit, is connected to the second node.

10. A display device, comprising a plurality of pixel units arranged in an array, wherein each of the plurality of pixel units comprises the pixel circuit according to claim 1 and a light-emitting element.

11. The display device according to claim 10, further comprising a plurality of scanning lines, wherein the plurality of pixel units are arranged in a plurality of rows, control terminals of data writing circuits of pixel circuits of pixel units in a row are connected to a same scanning line, control terminals of compensation-and-reset circuits of the pixel circuits of the pixel units in the row are connected to another scanning line, and the another scanning line is also connected to control terminals of data writing circuits of pixel circuits of pixel units in a previous row.

12. The display device according to claim 10, further comprising a plurality of scanning lines and a plurality of reset control lines, wherein the plurality of pixel units are arranged in a plurality of rows, control terminals of data writing circuits of pixel circuits of pixel units in a row are connected to a same scanning line, and control terminals of compensation-and-reset circuits of the pixel circuits of the pixel units in the row are connected to a same reset control line.

13. A driving method for the pixel circuit according to claim 1, comprising: the reset and compensation stage, the data writing stage, and the light-emitting stage;

wherein in the reset and compensation stage, the compensation signal is input, the compensation-and-reset circuit is turned on, the first storage circuit is reset, and the drive circuit is compensated so that the drive circuit is in a fixed off-bias state;

in the data writing stage, the scanning signal and the data signal are input, the data writing circuit is turned on, the data writing circuit writes the data signal into the first storage circuit, and the second storage circuit couples and adjusts a voltage of the second node according to a voltage variation of the first node; and in the light-emitting stage, the light-emitting control signal is input, the light-emitting control circuit and the drive circuit are turned on, the second storage circuit couples and adjusts a voltage of the first node according to a voltage variation of the second node, and the light-emitting control circuit applies the driving current to the light-emitting element to drive the light-emitting element to emit light;

wherein a duration of the light-emitting control signal holding an inactive level is approximately equal to a sum of a duration of the compensation signal holding an active level and a duration of the scanning signal holding an active level.

* * * * *